United States Patent [19]

Stautland et al.

[11] Patent Number: 4,565,124

[45] Date of Patent: Jan. 21, 1986

[54] SCREW PRESSES

[75] Inventors: Thomas Stautland, Loddefjord; Steinar F. Jacobsen, Knarrevik, both of Norway

[73] Assignee: Stord Bartz A/S, Bergen, Norway

[21] Appl. No.: 548,080

[22] Filed: Nov. 2, 1983

[30] Foreign Application Priority Data

Nov. 10, 1982 [NO] Norway ..... 823739

[51] Int. Cl.[4] ..... B30B 9/16

[52] U.S. Cl. ..... 100/117; 100/146

[58] Field of Search ..... 100/116, 117, 127, 145–150

[56] References Cited

U.S. PATENT DOCUMENTS

| | | | |
|---|---|---|---|
| 3,021,782 | 2/1962 | Ginaven | 100/117 X |
| 3,035,511 | 5/1962 | Hayes | 100/117 |
| 3,478,679 | 11/1969 | Bauserman | 100/117 |
| 3,624,729 | 11/1971 | Hoover | 100/117 |
| 3,943,034 | 3/1976 | Wallen | 100/117 |
| 4,438,691 | 3/1984 | Solberg | 100/117 |

FOREIGN PATENT DOCUMENTS

| | | | |
|---|---|---|---|
| 1127727 | 9/1968 | United Kingdom | 100/117 |

*Primary Examiner*—Peter Feldman

*Attorney, Agent, or Firm*—Kenyon & Kenyon

[57] ABSTRACT

Screw press with one or more screws having a sieve surface. The screw is fabricated to have a reinforced construction by way of a rigid main stem portion disposed radially inwards of a rigid sieve-forming surface portion and reinforcing ribs disposed between these portions. Screw threads of the screw are secured directly to the sieve-forming surface portion while a drainage duct for draining fluid from the latter portion is formed between this portion and the main stem portion.

10 Claims, 5 Drawing Figures

SCREW PRESSES

This invention relates to screw presses.

Such presses are to be used in general for dehydrating fibrous, fluid-containing material and can, for example, be used as sugar beet presses, as presses for fish and meat material, etc. It has been usual to employ a sieve surface in a jacket which surrounds at least one screw so that one has drainage of fluid in a direction radially outwards from the screw. In order to increase dehydration, there has also been employed, in certain circumstances, a sieve surface on the screw of the press. However, such sieve surfaces have, for practical reasons, been limited to certain local regions of the screw since the holes made in the screw for such sieve surfaces and associated drainage ducts have reduced to a substantial degree the rigidity and strength of the screw.

An objective of the present invention is a press where the drainage of fluid from the material which is to be treated by the press can be increased via sieve surfaces on the screw thereof without thereby weakening the rigidity and strength of that screw. The aim is to provide a special construction of the screw where the major portion of the outer surface thereof can be furnished with a sieve surface while the requisite rigidity and strength of the screw is maintained relative to conventional screws.

Accordingly, the present invention resides in a screw press for dehydrating fluid-containing materials which comprises at least one screw means mounted for rotation within a housing having a sieve surface and comprising a rigid main stem portion disposed radially inwards of a rigid sieve-forming surface portion and reinforcing ribs disposed between said stem and surface portions, said screw means having its screw threads secured directly to said surface portion and said stem portion and said surface portion defining therebetween a space forming drainage duct means for draining fluid from said sieve-forming surface portion.

A major advantage of the present invention is that the combined sieve surface area of the press can be increased to a significant degree. It is proved particularly advantageous to be able to increase the combined internal diameter of the sieve surface area of the press screw. For one thing, with this solution the drainage fluid can be removed in a direction radially inwards into the press via the screw, at a rate approximately the same as that which is possible when removing drainage fluid in a direction radially outwards from the press, via the jacket which surrounds the press screw. This has great significance for the combined dehydrating effect of the material which is treated in the press.

Furthermore, the screw of the press can, in addition, be fabricated in a simple manner, with a moderate consumption of material for the screw, into a satisfactorily rigid and strong construction, the inner main stem portion and the outer sieve surface portion separately having great self-rigidity and, in addition, being reinforced by the intermediate web-forming reinforcing ribs.

It has been possible to arrive at an especially simple construction of the outer surface of the screw in various cylindrical and conical shapes in the longitudinal direction of the press screw, as required, in the single current press. This can be achieved by allowing the sieve-forming surface portion itself to determine the shape and form of the outer surface of the press screw in the individual case, while the main stem portion can, if necessary, have a form and a shape which is totally independent of the form and shape of the surface portion. The portions can be readily adapted to each other by correspondingly fashioning separate reinforcing ribs which determine the curvature of the sieve-forming surface portion. The sieve-forming surface portion can thus be mounted, in sections, between each pair of reinforcing ribs and fastened directly to the reinforcing ribs and the neighbouring sieve surface sections with the aid of seam welds and/or other fastening means.

By the said layered fabrication of the screw of the press, there is also the possibility of allowing the intermediate space between the main stem portion and the sieve-forming surface portion to form a drainage duct or drainage ducts along or across the screw or along or across the reinforcing ribs.

In order to obtain an especially good reinforcement of the screw in its longitudinal direction, it is preferred that the reinforcing ribs extend in this longitudinal direction, preferably with uniform intermediate spaces between the ribs reckoned in the peripheral direction of the screw.

In order to obtain longitudinal drainage ducts in the longitudinal direction of the screw, it is preferred that the reinforcing ribs define, between the main stem portion and the sieve-forming surface portion, a corresponding number of drainage ducts in the peripheral direction of the screw.

In order to achieve an especially good drainage effect via the screw, it is preferred that the screw thread of the screw is constituted by a sieve surface-forming front wall and a rear wall which together with the sieve-forming surface portion define an internal hollow space which communicates with a drainage duct disposed radially within and between the main stem portion and the sieve-forming surface portion. By such a solution, there is the possibility of utilising the drainage ducts between the main stem portion and the sieve-forming surface portion also as drainage ducts from the hollow space in the screw thread, for example, by allowing said hollow space to communicate directly with the drainage ducts via holes (apertures) in the surface portion where this borders the hollow space.

In order that the invention can be more clearly understood, convenient embodiments thereof will now be described, by way of example, with reference to the accompanying drawing in which.

Figure 1:
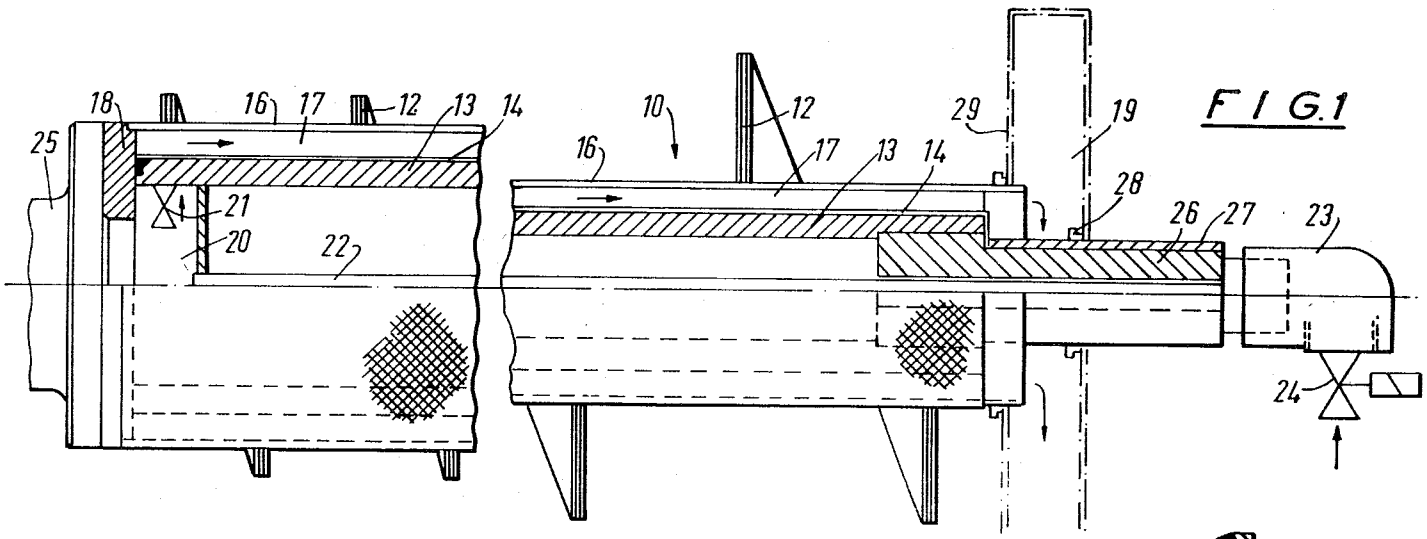
FIG. 1 is a view of a screw press illustrating only its two opposite ends, partly in side elevation and partly in section.
Figure 2:
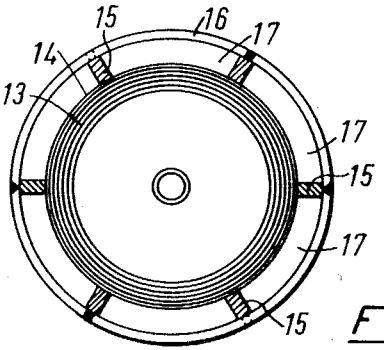
FIG. 2 is a cross-section of the screw of the screw press of FIG. 1 at its outlet end.
Figure 4:
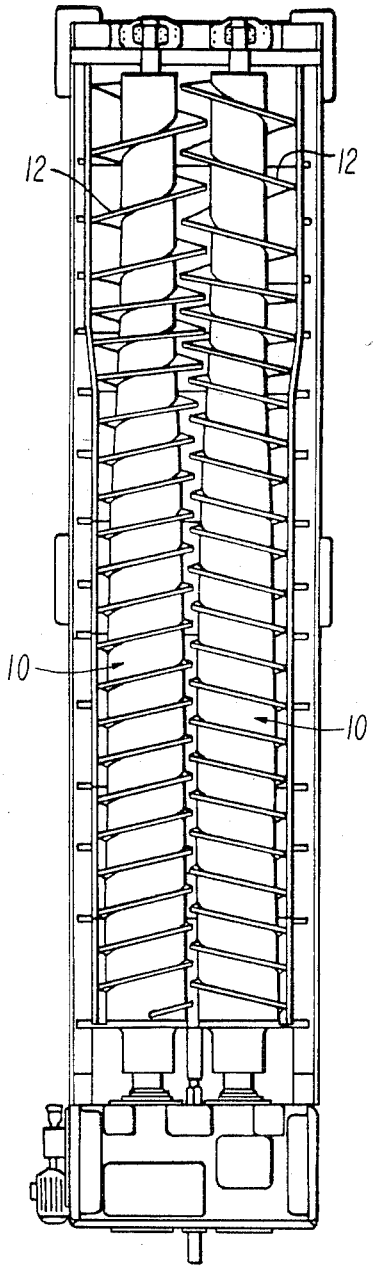
FIG. 4 illustrates a horizontal sectional view of a screw press employing two screws.

Referring to FIGS. 1 and 2, there is shown a single screw 10 of a screw press. Instead of a single screw, the screw press can have two or more such screws rotatable in the same or mutually opposite directions as illustrated in FIG. 4.

Figure 5:
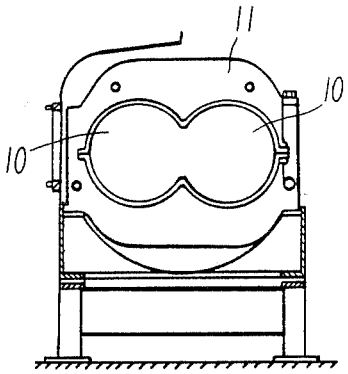
FIG. 5 illustrates a cross-sectional view of the screw press of FIG. 4.

The screw 10 or the pair or set of screws are surrounded by a housing means such as a jacket 11 as indicated in FIG. 5 with a sieve surface which has an inner surface corresponding substantially to the external generatrix of the screw or screws. In the jacket, there is cut out, in the usual manner, a material feed passage at one end of the press (right side in FIG. 1), while there is formed a press cake outlet at the opposite end of the press (at the left side of FIG. 1) between the jacket and the screw. Of note, the double screw press may be of a construction as described in U.S. Pat. No. 4,438,691.

The screw 10 which is horizontally disposed in the jacket is provided with a rigid screw stem which carries a continuous single screw thread 12 but in practice can, if necessary, be provided with certain screw stem portions which are provided with threads while other screw stem portions are without threads. From FIG. 1, it is evident that the screw 10 has a screw stem which has a uniformly increasing diameter from the inlet end of the press to its outlet end, while its screw thread 12 has a large external diameter at the inlet end of the press and a smaller external diameter at the outlet end of the press. The screw thread 12 has its largestpitch at the inlet end of the press and its smallest pitch at the outlet end of the press.

The form of the screw stem and the shape of the screw thread 12 as illustrated can be varied significantly from press to press within the same type of screw press or with different types of screw press (sugar beet presses, presses for fish and meat material, etc.). In the present instance, the question is a fundamentally new construction of the screw of the screw press which can be readily adapted for various types of presses having different forms and different shapes of screw stems and screw threads. Such screws can, if necessary, replace the screws in existing presses.

Figure 3:
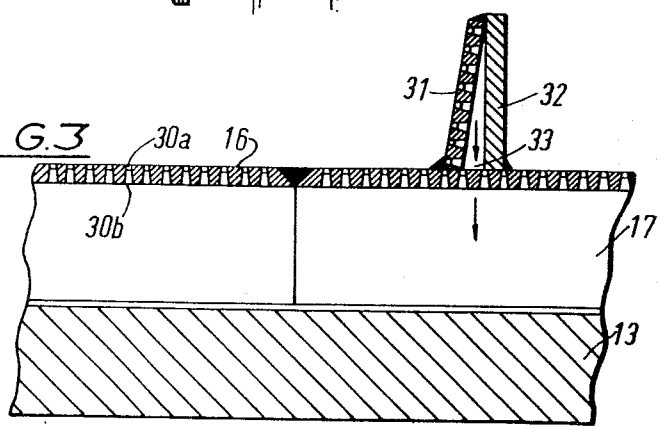
FIG. 3 is a fragmentary longitudinal section of a screw of a screw press of an alternative embodiment.

Screw 10 is fabricated from a series of slightly conical pipe pieces welded together end-to-end which form a rigid main stem portion 13, made of conventional quality steel. The main stem portion 13 is externally covered by a thin-walled plate 14 (1–2 mm thickness) of rust-free steel. In the longitudinal direction of the main stem portion 13, there extend a series (six) of mutually parallel reinforcing ribs 15 (FIG. 2) arranged with uniform angular intermediate spaces and which provide extra reinforcement for the main stem portion 13 in its longitudinal direction. The reinforcing ribs 15 are also of rust-free steel. To the radially outwardly directed surface of the reinforcing ribs 15, there is secured a sieve-forming surface portion 16 composed of a series of plate sections with through sieve openings 16*a* as shown in detail in FIG. 3. The sieve-forming surface portion 16 is also made of rust-free steel and the plate sections are, as shown in FIGS. 2 and 3, mutually welded together, at the same time as they are permanently welded to the reinforcing ribs 15 (or at any rate certain of these). The sieve-forming surface portion 16 will, together with the reinforcing ribs 15, exert a significant reinforcement of the main stem portion 13, portion 16 and portion 13 together with ribs 15 jointly forming a specially reinforced screw stem.

The outer form and shape of the screw stem can deviate from the form and shape of the main stem portion 13, the reinforcing ribs 15 by their fashioning being able to determine the form and shape of the sieve surface portion 16 and thereby the form and shape of the screw stem.

From FIG. 2, it will be evident that the six reinforcing ribs illustrated between the main stem portion 13 and the sieve-forming surface portion 16 form correspondingly six angularly defined drainage ducts 17 in the longitudinal direction of the press screw. On rotating the screw 10 during the pressing operation, the portions of fluid which are forced through the openings 16*a* in the sieve-forming surface portion 16 and which are collected in the ducts 17, will be held locally limited relative to each other. As a consequence of the conical shape of the main stem portion 13, one gets a certain backwards and forwards rinsing of the drainage fluid in the ducts 17. Normally, the ducts are kept clean of sediment material deposits as a result of the backwards and forwards rinsing drainage fluid in the ducts. Even if one can empty out drainage fluid at opposite ends of the screw 10 provision is made, however, for shutting off the ducts 17 at one end (left end of FIG. 1) of the screw by means of an annular end piece 18. Drained off press fluid is led subsequently endways outwards into a collecting duct 19 (represented by chain lines in FIG. 1) at the other end of the screw (right end of FIG. 1).

In order to obtain further cleaning of the ducts 17, extra rinsing fluid can be supplied to the ducts 17 from a common water supply chamber 20 disposed internally in the screw 10 at its one left end of FIG. 1. Each duct 17 can be connected to the chamber 20 via a back pressure valve 21. There is shown a water supply arrangement for the chamber 20 which consists of a feed pipe 22 fixed centrally in the main stem portion 13 and connected to a feed housing 23 which is rotatably mounted on the pipe 22. At 24, there is shown a shut-off valve on the housing 23.

The screw body of the press is driven via a drive shaft 25 which is fixed flanged to end piece 18 of the screw 10 at one end of the press, while the opposite end (right end of FIG. 1) of the screw is freely rotatably mounted in a suitable bearing via a pipe piece 26 projecting outwardly endways from the main stem portion 13. At 27, there is shown a bearing-forming sleeve and at 28 and 29 there are shown sealing means between the collecting duct 19 and the sleeve 27 and between the collecting duct 19 and the sieve-forming surface portion 16 of the screw 10, respectively.

Referring to FIG. 3, there is shown a construction for the bores in the sieve plate sections where a relatively short and narrow inlet passage 30*a* and a longer, conically expanding outlet passage 30*b* are shown in each of the bores.

A hollow screw thread 31, 32 is shown consisting of a sieve surface-forming, perforated front wall 31 and an unperforated rear wall 32 which are permanently and separately welded to the outer periphery of the sieve-forming surface portion 16 and which converge radially outwards towards each other at the peripheral edge of the screw thread. From the hollow space 33, which is formed between the walls 31 and 32 and the sieve-forming surface portion 16, drainage fluid is led, via the bores, in the portion 16 inwardly into adjacent ducts 17 in the screw so that one gets a collected draining off of the drainage fluid from the hollow spaces 33 and the ducts 17 to the collecting duct 19. If desired, hollow spaces 33 of the screw threads can be provided with extra transverse partition walls (not shown) which each define several resulting hollow space portions in the screw, without mutual communication between the hollow space portions.

A screw press utilising a single screw has the whole of its periphery surrounded by the sieve-forming outer jacket. As a result, there is the possibility of obtaining a uniform loading on the screw over its whole periphery via the counter-pressure which is transferred from the jacket, via the material being dehydrated, to the screw.

On the other hand, where the screw press employs two or more screws, the situation is rather different. For instance, with two screws only portions of the peripheries of the screws are surrounded by the outer jacket, the remaining portions of the periphery of a screw pushing up against the periphery of the adjacent screw. By virtue of the interference effect between the screws, material introduced into the intermediate space between them will normally have a tendency to bend the screws laterally outwards from each other.

Nevertheless, when screws are used designed as described in the afore-mentioned embodiments, such bending forces can be successfully withstood.

I claim:

1. Screw press for dehydrating fluid-containing materials which comprises housing means having a sieve surface, a pair of horizontally disposed screw means mounted in side-by-side relation for rotation within said housing means, each said screw means comprising a rigid main stem portion disposed radially inwards of a rigid sieve-forming surface portion and reinforcing ribs disposed between said stem and surface portions, each said screw means having screw threads secured directly to said surface portion, said stem portion and said surface portion defining therebetween a space forming drainage duct means for draining fluid from said seive-forming surface portion.

2. Screw press according to claim 1, wherein the reinforcing ribs extend longitudinally of the screw means.

3. Screw press according to claim 2, wherein the ribs are uniformly spaced in the peripheral direction of the screw means.

4. Screw press according to claim 3, wherein the drainage duct means are in the form of drainage ducts defined by a corresponding number of the reinforcing ribs and in the peripheral direction of the screw means.

5. Screw press according to claim 1, wherein the screw threads of the screw means are constituted by a sieve-forming front wall and a rear wall which together with the surface portion define an internal hollow space communicating with the drainage duct means.

6. A screw press comprising a jacket having a sieve surface; and a pair of horizontally disposed parallel screws rotatably mounted side-by-side in said jacket, each said screw including a rigid main stem, a plurality of reinforcing ribs extending longitudinally of said stem and a rigid sieve-forming surface portion secured to said ribs to define drainage ducts with and between said ribs.

7. A screw press as set forth in claim 6 wherein at least one of said stem and said surface portion of each screw is conical.

8. A screw press as set forth in claim 6 wherein each sieve-forming surface portion is permanently secured to said reinforcing ribs to reinforce said main stem.

9. A screw press as set forth in claim 6 which further comprises a hollow screw thread permanently secured to said sieve-forming surface portion to define a hollow space communicating with at least one of said drainage ducts, said screw thread having a sieve-forming front wall.

10. A screw press as set forth in claim 6 wherein said main stem is conical whereby drainage fluid in said ducts is able to move forwards and backwards during rotation of the screw.

* * * * *